United States Patent [19]

Andresen

[11] 4,372,118

[45] Feb. 8, 1983

[54] LIQUID CABLE

[76] Inventor: Herman J. Andresen, 726 Carriage Hill Dr., Glenview, Ill. 60025

[21] Appl. No.: 916,869

[22] Filed: Jun. 19, 1978

Related U.S. Application Data

[63] Continuation of Ser. No. 735,799, Oct. 26, 1976, abandoned.

[51] Int. Cl.[3] ..... F15B 7/08

[52] U.S. Cl. ..... 60/583; 60/586; 60/591; 60/533

[58] Field of Search ..... 60/583, 584, 582, 586, 60/591, 562, 581, 592, 590; 92/60, 131, 143, 133; 254/93 R

[56] References Cited

U.S. PATENT DOCUMENTS

| | | | |
|---|---|---|---|
| 2,072,693 | 3/1937 | Volkert | 60/592 |
| 2,246,348 | 6/1941 | Coffey | 60/586 |
| 2,300,675 | 11/1942 | Jones | 60/584 |
| 2,468,489 | 4/1949 | D'Arcey | 60/592 |
| 2,536,140 | 1/1951 | Rockwell | 60/591 |
| 3,618,473 | 11/1971 | Miller | 92/133 |
| 3,985,063 | 10/1976 | Lemon | 92/60 |

FOREIGN PATENT DOCUMENTS

| | | | |
|---|---|---|---|
| 435456 | 9/1935 | United Kingdom | 60/586 |
| 1299432 | 12/1972 | United Kingdom | 60/583 |
| 1375990 | 12/1974 | United Kingdom | 60/583 |

*Primary Examiner*—Abraham Hershkovitz

*Attorney, Agent, or Firm*—Neuman, Williams, Anderson & Olson

[57] ABSTRACT

A liquid cable transfer device is provided for transmitting input forces and/or displacements to corresponding output forces and/or displacements. The transfer device includes a section of tubing adapted to accommodate liquid under pressure, and terminal units attached to opposite ends of the tubing. Each unit includes a piston and a biasing element acting against the piston whereby the pistons of both units coact to maintain a certain minimum liquid pressure within the tubing. The piston displacement stroke within one terminal unit caused by either a pull or push input force being applied thereto is transmitted to the piston within the second terminal unit whereby the latter piston is displaced from its initial equilibrium position a predetermined amount.

1 Claim, 12 Drawing Figures

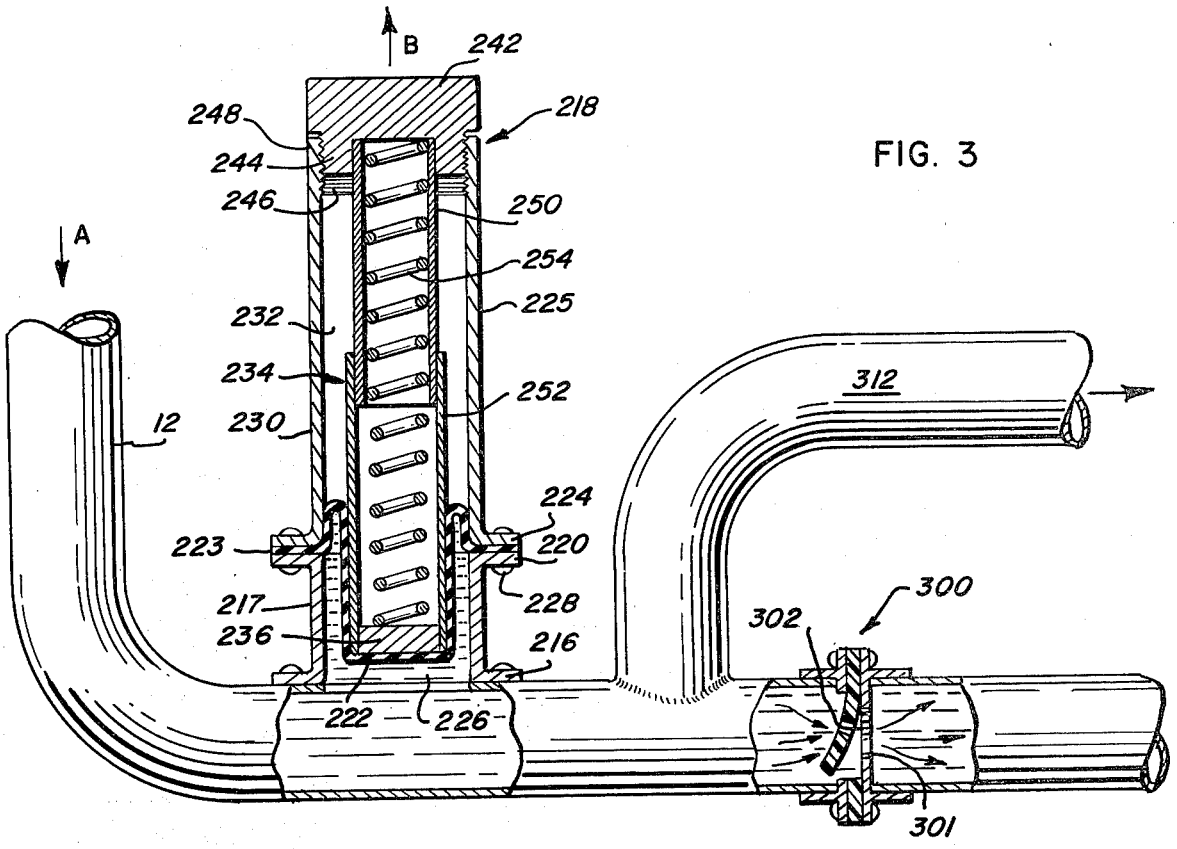
FIG. 3
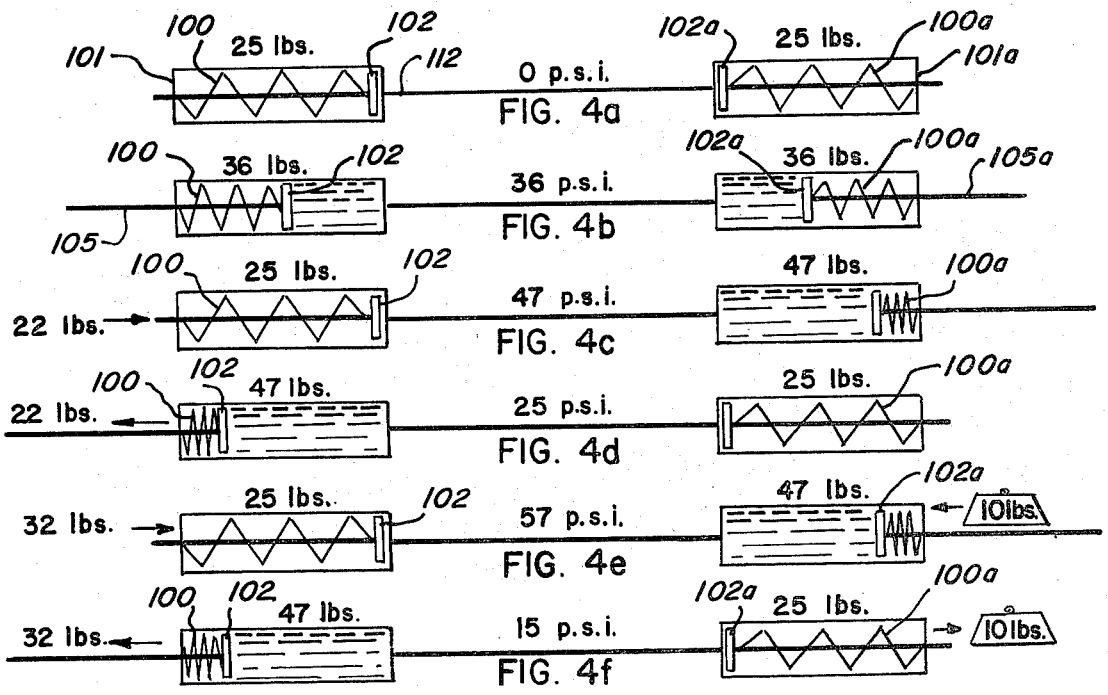
FIG. 4a
FIG. 4b
FIG. 4c
FIG. 4d
FIG. 4e
FIG. 4f

LIQUID CABLE

This is a continuation of application Ser. No. 735,799 filed Oct. 26, 1976, now abandoned.

BACKGROUND OF THE INVENTION

This invention relates to liquid-filled force and displacement transfer cable systems, and more particularly to transfer cable systems which are self-contained, complete and designed to receive and reproduce external mechanical signals at selected points remote from each other with the transmitting medium being a non-compressible liquid. The systems are filled in their entirety with a suitable liquid which is preferably sealed and non-replenishable.

Transfer cable systems generally find application where accurate but remotely controlled force or displacement transfers are required, and where a rigid or inflexible cable would not be feasible. Such cable systems could be adapted to control fluid power circuits, to effect manipulation of switches and gears, or to insure the precise positioning of controls (e.g., where forces under 250 lbs. are applied and linear piston displacement of approximately 3 inches is required). Typical force and displacements associated with this type of cable system are forces of less than 100 lbs. and displacements up to 1½ inches. More specifically, such cable systems might find application in aircraft, marine or power plant related machinery. In providing a means for transferring signals to actuate controls, for example, the cable system will not rely on any source of external power to effectuate such a transfer. The cable system merely receives and reproduces mechanical motions as signals, and would therefore allow manual manipulation of remotely located controls during electrical power failures or the like. The necessity of assuring accurately predictable force and displacement transfers for both push and pull inputs made from either end of a single cable have not been assured in the past.

OBJECTS OF THE INVENTION

Accordingly, it is an object of the present invention to provide an improved, low cost, and simplified liquid-filled force and displacement transfer cable system wherein accurately predictable force and displacement transfer is assured.

It is another object of this invention to provide a liquid-filled force and displacement transfer cable system capable of transmitting push or pull input forces and displacements to corresponding output push or pull forces.

It is still another object of this invention to provide a liquid-filled force and displacement transfer cable system capable of accepting force inputs from a variety of locations within the system.

SUMMARY OF THE INVENTION

These objects are achieved by a liquid cable force transfer device which includes a section of rigid, semi-rigid or flexible tubing, or a combination thereof, of a desired length adapted to accommodate therein a non-compressible liquid under pressure. Connected to opposite ends of the tubing are terminal units or input/output elements. Each terminal unit has disposed therein a piston to or through which input or output forces are registered. The pistons on opposite terminal units act between predetermined stroke limits thereof against the liquid within the tubing whereby one piston is responsive to the force applied to the other piston. A piston biasing element or spring is included within each terminal unit and respective biasing elements or springs cooperate with one another to maintain a predetermined liquid pressure within the tubing. Each terminal unit includes a piston portion to which an external force actuating shaft can be secured. In such a configuration, the transfer device will accept both push or pull inputs at either end thereof and such inputs will be transmitted to the opposite terminal unit.

Other objects, advantages and features of the invention will become apparent upon reading the following detailed description and appended claims, and upon reference to the accompanying drawings.

BRIEF DESCRIPTION OF THE DRAWINGS

For a complete understanding of this invention, reference should not be had to the embodiments illustrated in greater detail in the accompanying drawings wherein:

FIG. 3 is an enlarged, fragmentary, partial longitudinal sectional view of a modification of the transfer device of FIG. 1.

FIGS. 4*a*–4*f* are schematic representations of the device of FIG. 1 illustrating pressure, force, and displacement relationships under various operating conditions.

While the invention will be described in connection with a preferred embodiment, it will be understood that it is not intended to be limited thereto. On the contrary, it is intended to cover all alternatives, modifications and equivalents as may be included within the spirit and scope of the invention as defined by the appended claims.

DESCRIPTION OF THE PREFERRED EMBODIMENT

Figure 1:
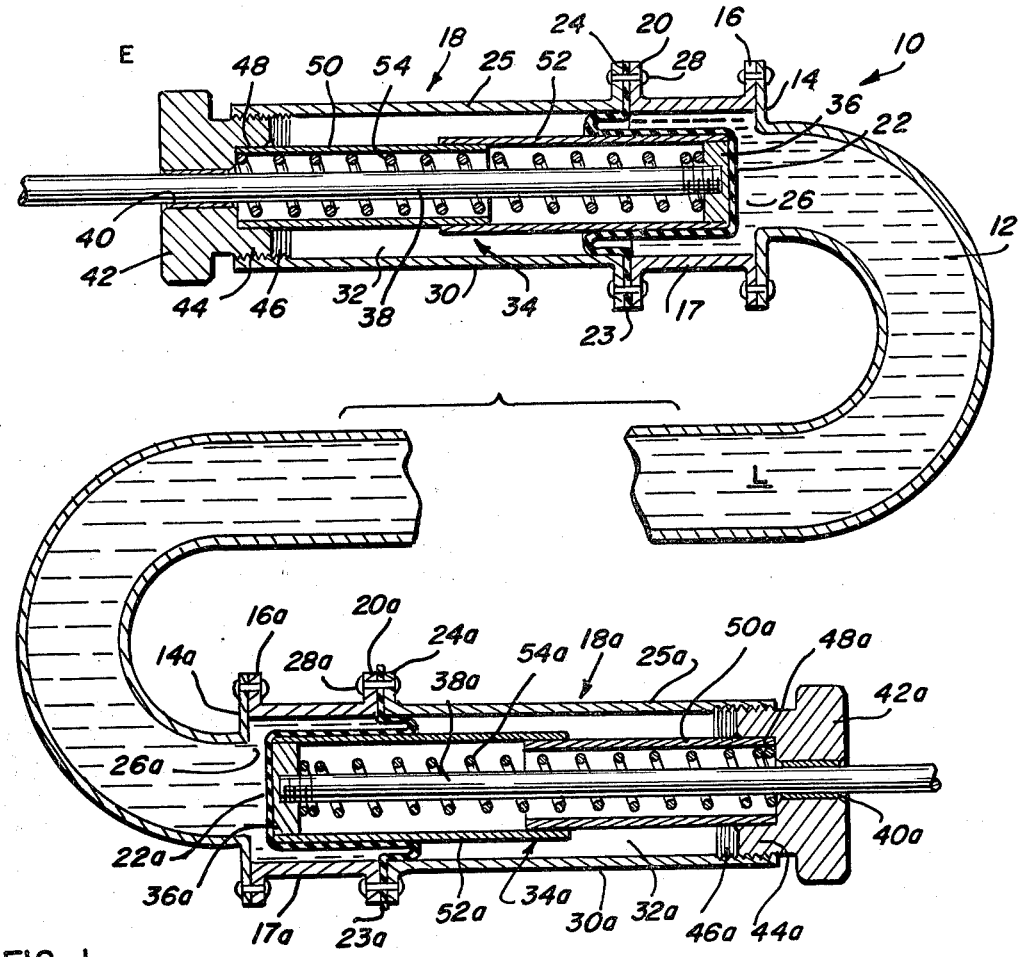
FIG. 1 is an enlarged, fragmentary, longitudinal sectional view of one embodiment of a liquid cable force transfer device employing principles of this invention.

Referring to the drawings and principally to FIG. 1, one embodiment of a liquid cable force transfer device 10 is shown wherein a predetermined length of rigid, semi-rigid or flexible tubing 12, or a combination thereof, is provided. The tubing is of such construction as to permit abrupt directional changes, while at the same time accommodating and maintaining a non-compressible liquid L therein at predetermined pressures. The liquid L may be commonly employed hydraulic fluid or other liquid that has substantially constant fluidity over a wide temperature range. Ends 14, 14*a* of tubing 12 are securely affixed to flanges 16, 16*a* formed at one end of sleeve-like base portions 17, 17*a*, each of the latter comprising a component of a terminal unit 18, 18*a*. The units in the illustrated embodiment are of like construction and are disposed at opposite ends of the tubing. Only one unit 18 will hereinafter be described, with corresponding reference numbers having the subscript "a" identifying the same components embodied in unit 18*a*.

The base portion 17 may be positioned within an opening formed in a stationary wall (not shown) by suitable means so as to maintain the unit in a fixed location. The opposite end of base portion 17 from flange 16 is provided with an outwardly projecting flange 20. A rolling diaphragm 22 is provided which has the periphery 23 thereof clamped to flange 20 by an end flange 24 formed on a cylindrical terminal body 25. The diaphragm is of a non-pourous and pliable material and defines a piston chamber 26 within base portion 17. Chamber 26 is in direct communication with the interior of tubing 12 whereby mechanical impulses from the terminal unit will be translated into liquid pressures within the tubing. The flanges 20, 24 are secured in clamping relation with the diaphragm periphery 23 by fastener 28. The cylindrial wall 30 of terminal body 25 delimits a cavity 32, which accommodates therein a biasing assembly 34. The assembly 34 includes at one end a piston 36, which acts against diaphragm 22 between predetermined stroke limits thereof. Extending from piston 36 and away from the diaphragm is an elongated rod 38 which is disposed axially of body 25. The rod exits the body portion through an opening 40 provided in a terminal cap 42, the latter being threadably mounted on the end of the body 25 opposite the flange 24. Forces and displacements transmitted through the cable device are received or initiated through the portion of rod 38 extending beyond cap 42. A portion 44 of cap 42, and the corresponding inner end segment 46 of body portion 25 threadably engage and retain the cap in predetermined positions relative to the body portion 25. Securely attached to the inwardly facing recessed surface 48 of cap 42 is an end of an aligning sleeve 50. The sleeve extends towards piston 36 a distance greater than one-half of the length of body portion 25.

A second aligning sleeve 52 is secured at one end to the periphery of piston 36. The opposite end of sleeve 52 is at all times in telescoping relation with the corresponding end of sleeve 50. Thus, when piston 36 is moved within terminal unit 18, the overlapping relationship of sleeves 50 and 52 will help to maintain the movement of the piston axially of terminal unit 18. Contained within sleeves 50, 52 and resiliently abutting piston 36 and the inside surface of cap 42 is a coil spring 54. The spring has a predetermined spring constant and extends axially of terminal unit 18 and encompasses rod 38. When the spring 54 is extended the fullest amount within the confines of terminal unit 18, a predetermined spring compressive force will continue to work against piston 36. The spring will urge piston 36 towards tubing 12 since the piston is free to move while cap 42 is securely held in place. As such, the compressive force of spring 54 working against piston 36 may be increased or decreased by adjusting cap 42 relative to the end 46 of the body portion 25. Seal bearings (not shown) may be included between sleeves 50 and 52 or along opening 40 of cap 42 to facilitate relative movement of adjacent components. It should be understood that rolling diaphragm 22 is of sufficient dimension to assure conformity with the shape of piston 36 no matter what increment of its stroke it is occupying within the terminal unit 18. Likewise, it should be clear that when the piston is displaced towards cap 42, spring 54 will be compressed, increasing the spring compressive force acting against the piston. In like fashion, if the piston is displaced away from cap 42, the spring 54 will be extended with a resulting decrease in spring compressive force.

The tubing 12 and chamber 26 of each terminal unit 18, 18*a* are completely filled with the suitable non-compressible liquid L, the fluidity of which remains substantially constant over a wide range of environmental conditions. The amount of liquid L introduced into the tubing and chamber is such that the coil springs 54 at the terminal units will be compressed a predetermined amount, thus causing the liquid to be under a given pressure when the unit pistons are at an equilibrium or rest condition E.

In operation, the spring compressive force and therefore liquid pressure is first determined by the volume of liquid in the system, the spring constants and the adjustment of cap 42 on body portion 25. The greater the spring compressive force, the greater the liquid pressure within the tubing 12 when the piston 36 is in its equilibrium or rest position. Thus, with a predetermined liquid pressure set within the tubing, a push or pull input can be applied to a terminal unit at either end of tubing 12 and the other unit will be precisely responsive to such input.

As best shown in FIGS. 4*a*–4*f*, the relationships between input force and displacement piston stroke, and output force and displacement for push or pull forces are schematically presented. In FIG. 4*a*, it will be assumed that a particular piston biasing spring 100, 100*a* when fully extended within the terminal unit 101, 101*a*, will exert a force of 25 lbs. against pistons 102, 102*a* provided no liquid is within the tubing 112 or units 101, 101*a*. Thus, there is zero pressure (psi) within the tubing.

In FIG. 4*b*, the tubing and chambers have been filled with liquid so that springs 100, 100*a* have both been compressed to one-half their total allowable movement within their respective chambers, or to a compression force of, for example, 36 lbs. For the purposes of this illustration, the piston area will be assumed to be one square inch so that one pound of force working against the piston will result in 1 lb. per square inch (psi). As such, the pistons 102, 102*a* are stationary with compressive forces of the springs being balanced by the liquid pressure and system of forces, resulting in an initial equilibrium condition under 36 psi. A shaft 105 extends from each piston 102 to or through which an external force or displacement is communicated.

FIG. 4*c* depicts the system of FIG. 4*b* when a push force of sufficient magnitude, as augmenting the associated spring force, has been applied against piston 102 to fully compress spring 100*a*. Because the liquid within the cable is substantially incompressible, the displacement of both pistons is identical provided the configuration of the pistons and springs at respective terminal units are the same. Assuming such a configuration, one spring will be fully expanded when the second spring is fully compressed. Assuming further that a spring compressive force of 47 lbs. occurs when a spring is fully compressed, spring 100*a* is now exerting a force of 47 lbs. which is being opposed through the incompressible liquid by spring 100, exerting a 25 lb. force. To achieve a second equilibrium, the external push force applied against piston 102 must be 22 lbs. This, in addition to the 25 lb. spring compressive force exerted against the same piston 102, will total 47 lbs. As such, opposing forces of 47 lbs. are established with the liquid pressure of 47 psi.

Referring to FIG. 4*d*, the system of FIG. 4*b* is again shown after a pull force of sufficient magnitude has been applied to the piston 102. In this instance, the pull force must overcome the compressive spring force of spring 100 when fully compressed, which opposes the pull input. Since it is known that when spring 100*a* is fully expanded, as would be the case here, a spring compressive force of 25 lbs. would be exerted, it will only be necessary to apply a pull input force sufficient to overcome all but 25 lbs. of the spring compressive force of spring 100 in order to achieve the equilibrium position with such a displacement. Thus, an input pull force of 22 lbs. would diminish the effective pressure on piston 102 from 47 lbs. to 25 lbs. As such, effective pressures working against pistons 102, 102*a* would be opposite and equal, with a resulting liquid pressure of 25 psi.

FIGS. 4*a*–4*d* thus illustrate the basic principles of the relationship between spring tension, piston displacement and liquid pressure.

FIGS. 4*e* and 4*f* illustrate specific applications of the above principles in performing work (i.e., moving a 10 lb. load a given distance), when either a push or pull input has been applied. For the purpose of these examples, it will be assumed that the system will be at its initial equilibrium position as shown at FIG. 4*b*.

The evaluation of forces and pressures working on the cable system when a push input is applied at one end thereof to do 10 lbs. of work at the opposite end (see FIG. 4*e*), closely parallel the explanation made in connection with FIG. 4*c*. However, to achieve the displacement of FIG. 4*c* an additional 10 lbs. of effective force must be overcome at piston 102*a*. Thus, in addition to the spring compressive force of 47 lbs. working against the piston 102*a*, an additional 10 lbs. will effectively resist movement of the piston, bringing the effective force working against piston 102*a* to 57 lbs. To achieve an equilibrium position with the desired displacement, the input push force when added to the compressive spring force working against piston 102 must equal 57 lbs. Since it is known that the extended spring will exert 25 lbs. of force against piston 102, an additional input push force of 32 lbs. will bring the system to equilibrium. Correspondingly, the pressure within the system will reach 57 psi.

The same evaluation of forces and pressures can be applied when a pull input force is exerted to do 10 lbs. of work. Again, as shown in FIG. 4*f*, the relationship between forces and pressures parallel those set forth in FIG. 4*d*. When the desired piston displacement has been achieved, as illustrated, the fully extended spring will have a spring compressive force of 25 lbs. working against piston 102*a*. However, the 10 lb. load or resistance force will detract from the effective pressure on piston 102*a*, since it will oppose any movement from the initial equilibrium position. As such the net effective force working against piston 102*a* will be 15 lbs. As such, the spring compression force of fully compressed spring 100 working against piston 102 must be overcome by the pull input until only 15 lbs. of effective force is working against piston 102. By applying 32 lbs. of pull input, thus, the effective force working on piston 102 will be reduced to 15 lbs. In this configuration, pistons 102, 102*a* oppose each other with forces of 15 lbs. and the system is in equilibrium with a 15 psi pressure therein.

As applied to a variety of spring tensions, spring constants, and/or fluid pressures, the formula depicted below may be utilized to predict the manner of operation of the cable system. Variables are defined as follows: $I_f$=input force, $O_F$=output resistance force, d=spring displacement, fd=displacement as a function of the spring constant, p=system pressure $F_0^1$=spring 1 force at equilibrium, $F_1^1$=spring 1 force when displaced d, $F_0^2$ and $F_1^2$ represents spring 2 force in the above positions. The formula has various parts, as follows:

$$F_1^1 = F_0^1$$

$$F_1^2 = F_0^2 + Fd$$

and $$F_1^1 - I_f = p$$

$$F_1^2 - O_f = p$$

so $$(F_0^1 - fd) - I_f = (F_0^2 + fd) - O_f$$

$$O_f - I_f = 2fd + (F_0^2 - F_0^1)$$

Thus, using the examples discussed above, the following results are obtained for a pull input force:

Known:

$$O_f = 10,\ I_f = 32,\ F_0^1,\ F_0^2 = 36$$

Result:

$$O_f - I_f = 2fd + (F_0^2 - F_0^1)$$

$$10 - 32 = 2fd + (36 - 36)$$

$$22 = 2fd$$

$$11 = fd$$

Having determined the fd, pressure and spring force as displaced from equilibrium can be determined. Since the fd will remain the same as long as the same springs are employed, a variety of conditions can be determined when different inputs/outputs or pressures are utilized.

It should be noted that as applied to the examples, when a 26 lb. load is to be moved via a pull input, the system will not assure equal input and output displacements. This occurs because under such circumstances, the pressure within the system will drop below 0 psi, and the liquid will separate. The limit of the system will thus depend upon the initial equilibrium pressure within the system, and the spring rates of the springs utilized in the terminal units. System pressure must remain at or above 0 psi at all times to achieve the accurate pull responses to pull inputs.

Figure 5:
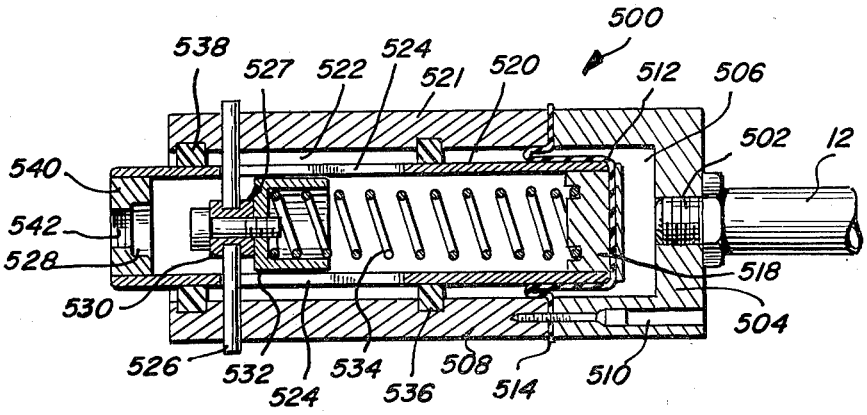
FIG. 5 is an enlarged sectional view of a first alternate embodiment of the terminal unit of FIG. 1 in a first position.
Figure 7:
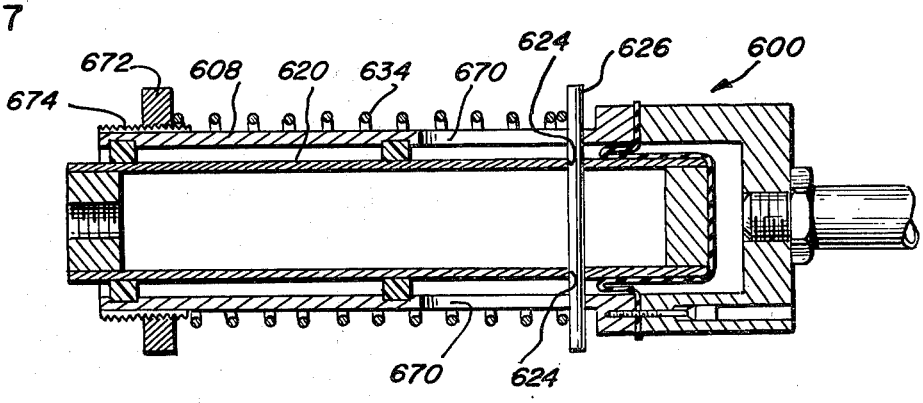
FIG. 7 is an enlarged sectional view of a second alternate embodiment of the terminal unit of FIG. 1.
Figure 6:
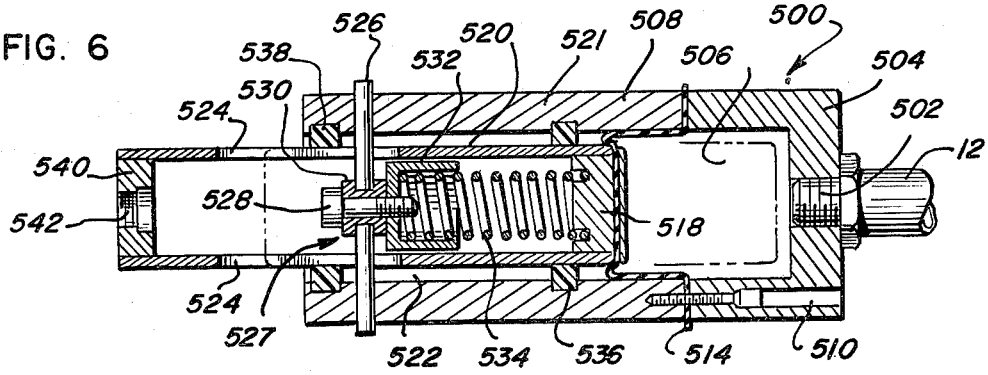
FIG. 6 is an enlarged sectional view of the terminal unit of FIG. 5 in a second position.

FIGS. 5, 6 and 7 illustrate alternate embodiments of terminal unit 18 that may be substituted for the terminal unit of FIG. 1 without detracting from the invention as set forth therein. Additionally, the force and pressure relationships and equations as set forth above apply equally to the embodiments to be hereinafter described.

Referring to FIG. 5, a terminal unit 500 is shown attached to tubing 12 via opening 502 at the distal end thereof. A terminal base portion 504 defines opening 502, and being substantially cup-shaped partially defines a piston chamber 506. Base 504 is removably secured to a terminal body portion 508 through screw-receiving opening 510. Because base 504 and body portion 508, the periphery 514 of a rolling diaphragm 512 is secured. The diaphragm 512 defines a wall of chamber 506, the volume of which is determined by the position of diaphragm 512. The diaphragm 512 is movably responsive to a piston member 518, mounted for reciprocal movement axially of terminal unit 500 between the position shown, and an alternate position shown in FIG. 6. Piston 518 is fixedly attached to a hollow sleeve 520 which extends through a cavity 522 defined by the wall 521 of body portion 508. A pair of longitudinally extending diametrically opposed slots 524 is formed in tubing 520. The slots are adapted to receive therethrough transversely extending axially aligned stop pins 526 which are fixedly carried by housing section 508. The reciprocal limits of travel of piston 518 are defined by the longitudinal extent of slots 524, and the position therein of the pins 526. Intermediate pins 526 and disposed axially of sleeve 520 is an adjustment assembly 527. The assembly 527 includes an adjustment screw 528 which extends through a screw collar 530. The ends of the pins 526 terminate within the collar. Threadably attached to the leading end of screw 528 is a cup-shaped member 532 which is adapted to receive one end of a coil spring 534. The other end of spring 534 resiliently engages piston member 518, urging the latter and diaphragm 512 toward opening 502. The entire assembly is located within sleeve 520, positioned substantially axially thereto. Bearing rings 536, 538 are positioned between sleeve 520 and the interior of body wall 521 so as to maintain the sleeve in axial alignment with the terminal unit 500 as the piston 518 and associated sleeve 520 reciprocate as a unit relative to the remainder of the terminal unit. Attached to the opposite or protruding end of sleeve 520 is a force transmitting cap 540. The cap is provided with a threaded opening 542 therein, which is adapted to hold a force transmitting rod or the like (not shown) and to facilitate access to and adjustment of the adjustment screw 528. With liquid present within the tubing 12 and chamber 506, an initial equilibrium pressure may be, in part, determined by the position of adjusting screw 528. The screw may be adjusted through opening 542 by a screwdriver or other similar device.

FIG. 7 illustrates a terminal unit similar to that shown and described in FIGS. 5 and 6. Corresponding components are identified by the same numbers as FIGS. 5 and 6, except for the prefix 6. In this embodiment, spring 634 is mounted externally of the body portion 608, and sleeve 620. In addition, diametrically aligned openings 624 are provided in sleeve 620 replacing slots 524. Openings 624 are only large enough to snugly receive a stop pin 626 therethrough, thereby enabling sleeve 620 and pin 626 to move as a unit. Elongated diametrically opposed slotted openings 670 are provided in body portion 608 and allow limited reciprocal movement of pin 626 and the associated piston and sleeve. The compressive force of spring 634 is adjustable via an external nut 672 threaded onto an exterior threaded surface portion 674 of the body 608. One end of spring 634 abuts nut 672 and the opposite end abuts pin 626. Terminal unit 600 is particularly well-adapted for ease of compressive spring force adjustment and for applications wherein the terminal unit is of such a small size that it would not be feasible to include an internal spring assembly.

Figure 2:
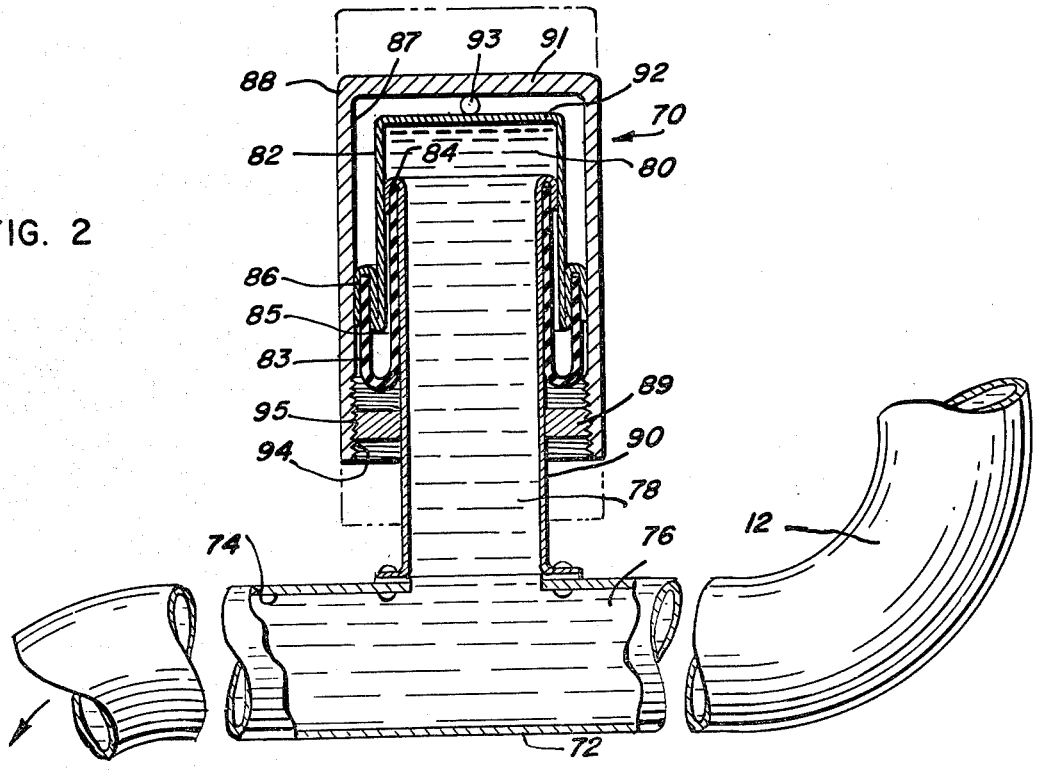
FIG. 2 is an enlarged, fragmentary, longitudinal sectional view of one auxiliary component adapted to be incorporated in the device of FIG. 1.

The equilibrium pressure within the device 10 may also be adjusted to a variety of desired settings by the utilization of a pressure assembly 70 (FIG. 2) which is inserted into tubing 12 between terminal units. Assembly 70 includes a T-shaped tube section 72 having the opposite ends 74, 76 of one leg thereof connected to the tubing 12. The second or transverse leg 78 of the T-shaped section 72 forms a portion of an internal chamber 80, which is in liquid communication with tubing 12. An inverted cup-shaped piston member 82 is provided which overlies the open end of leg 78. The member 82 in combination with leg 78 completely define the chamber 80. A rolling diaphragm 83, similar to the rolling diaphragm 22 of terminal unit 18 as described above, extends from the top edge 84 of leg 78 to the downwardly extending edge 85 of member 82. Edges of respective leg 78 and member 82 are turned back, with corresponding ends of the diaphragm crimped between the turned back portion and the edge of the respective components 78, 82. In addition, the outermost side 86 of L-shaped edge 85 extends parallel to the inner surface 87 of an overlying inverted cup-shaped adjusting cap 88. As such, member 82 is maintained in position axially of leg 78 when member 82 is adjusted relative thereto. The cap 88 is threadably connected to a fixed collar 89 formed on an exterior portion 90 of leg 78. The closed end 91 of the cap 88 is spaced from the closed end 92 of piston 82 by one, or more, ball bearings 93. The open end of the cap 86 is internally threaded at 94 and engages external threads 95 formed on fixed collar 89. Thus, cap 88 may be adjusted axially of leg 78, as suggested by phantom lines. As the cap 88 is adjusted, the volume of chamber 80 is modified, thereby modifying the liquid pressure within the tubing 12. The ball bearings 93 permit the cap 88 to be rotated independently of piston 82 to achieve a desired pressure adjustment. This assembly can also be used to alter the initial equilibrium position of a terminal unit and/or to alter its useful or effective stroke length.

Additional components are shown in FIG. 3 and include a pressure accumulator 218 connected to tubing 12 and a restrictor 300 disposed within the tubing and spaced from the accumulator. The accumulator 218 and restrictor 300 may coact to produce a variety of force and displacement transfer results including a time delayed output force and/or displacement or a sequenced output force and/or displacement, as hereinafter explained. The accumulator 218 is substantially the same structure as terminal unit 18 aforedescribed, with the accumulator elements corresponding to the elements of a terminal unit being numbered the same but in a two hundred series.

Restrictor 300, which is secured in a predetermined location within the tubing, is provided with a check valve arrangement 301 which includes a restricted opening 302 as a part thereof whereby the amount of liquid passing therethrough, in a first direction, per unit of time will be less than that which would normally pass through the tubing 12 while the fluid flow in the opposite direction will be unrestricted. In the FIG. 3 arrangement, a tributary tube section 312 is shown connected to tubing 12 at a location intermediate the accumulator and restrictor. The function of the section will be described in detail hereinafter.

If, however, the tributary tube section 312 is eliminated from the FIG. 3 arrangement, and an input push force is applied at a terminal unit (not shown), disposed upstream of the accumulator 218, in the direction of arrow A, a delayed output can be achieved at the terminal unit (not shown), disposed downstream of the restrictor 300. Under such conditions, a back pressure will build up upstream of restrictor 300 as the check valve 301 is urged into a closed position, and such pressure buildup will be deferred to the accumulator 218 and cause the pressure within the piston chamber 226 to increase thereby moving piston 236 in the direction of arrow B. Depending upon the compression force imposed on spring 254 by adjusting cap 242, a desired range of liquid pressures can be maintained within tubing 12. As the liquid passes through restrictor opening 302 to the downstream terminal unit, the back pressure will gradually decrease, and the accumulator 218 will resume its original equilibrium condition whereby a normal predetermined liquid pressure is again established throughout the device. Thus, the entire input force will be transferred to an output force, but over a prolonged period of time.

When the tributary tube section 312 is incorporated as shown in FIG. 3, sequential outputs from a plurality of terminal units (not shown) can be achieved. Assume as before that an input push force has been applied in the direction of arrow A. Because the liquid will take a path of least resistance, the output force will first be registered at a first terminal unit, not shown, attached to tube tributary 312. When the output capacity has been reached at the first terminal unit, a back pressure will begin to build as additional liquid volume seeks to pass through restrictor opening 302. Such pressure buildup will be absorbed within the accumulator 218, as aforedescribed, and cause a predetermined range of pressure to be maintained within the system until the entire accumulated hydraulic force has been transferred to a second terminal unit connected downstream of restrictor 300. With this arrangement, a sequenced output force transfer can be achieved. The number of terminal units and corresponding tributary tube sections can be varied from that shown, without departing from the scope of the disclosed invention.

Thus, it will be seen that a simple, inexpensive and efficient force transfer device has been provided which is substantially maintenance-free. The improved force transfer device is extremely versatile and does not require outside electrical, pneumatic or hydraulic sources to effect operation thereof.

I claim:

1. A liquid cable device for receiving and transmitting mechanical force and displacement, comprising first and second terminal units adapted to receive and transmit the mechanical force and displacement, each terminal unit including piston means mounted within a chamber formed in said unit for movement therein between predetermined stroke limits, and biasing means for biasing said piston means towards one end of said chamber for all positions of the piston means within the chamber; tubing means having a predetermined interior volume interconnecting the corresponding one ends of the terminal unit chambers; and a substantially noncompressible liquid disposed within said tubing means interior, the volume of said liquid being substantially greater than the tubing means interior volume and effecting a predetermined displacement of each of said piston means within the respective chamber whereby each piston means assumes a predetermined rest position intermediate the stroke limits thereof and is disposed a substantial distance from each stroke limit, the internal forces on the piston means being in balanced relation only when each piston means is in said rest position, the piston means of said terminal units coacting with one another to maintain the liquid within the tubing means under a continuous substantial positive pressure with respect to the environmental pressure of said device for all positions of adjustment of the piston means within said chambers, the application of an external mechanical force to effect displacement of a selected terminal unit piston means while in said rest position in either a direction towards or away from the chamber one end simultaneously altering the energization of the biasing means associated therewith and affecting an imbalance of internal forces within said selected unit chamber, the force imbalance within said selected unit chamber effecting a predicted correlative displacement of the non-selected terminal unit piston means in all possible stroke positions and simultaneously altering the energization of the biasing means associated therewith in opposite relation to the biasing means for the selected terminal unit piston means, upon removal of the external force the imbalance of internal forces within both of the terminal unit chambers effecting automatic return of both piston means to their respective predetermined rest positions, wherein the tubing means includes a liquid passage restrictor and a liquid pressure accumulator, said restrictor preventing substantially instantaneous transmission of the entire volume of liquid between the terminal units displaced by the continued application of an external input displacement force applied to the selected terminal unit piston means and moving the latter from the rest position towards the chamber one end of the selected terminal unit; said accumulator including a piston element disposed within an auxiliary chamber communicating with the tubing means at a location upstream from said restrictor and downstream of said selected terminal unit, and biasing means for urging said piston element into a predetermined first position within the auxiliary chamber, the volume of liquid displaced by the input displacement force and not instantaneously transmitted to the non-selected terminal unit accumulating within the auxiliary chamber and effecting displacement of the accumulator piston element from said first position and substantially simultaneous energizing of the accumulator biasing means such that said volume of liquid within said auxiliary chamber will be continually urged through said restrictor and to the non-selected terminal unit until said piston element returns to said first position and the external displacement input force continues to be applied to the selected terminal unit piston means and wherein the tubing means includes a tributary tubing member having one end thereof communicating with said tubing means upstream of said restrictor and the opposite end communicating with a third terminal unit, an input displacement force continually applied at said selected terminal unit positioned upstream of said accumulator generating a liquid displacement transmitted to said third terminal unit as a first output displacement, and subsequently to said non-selected terminal unit as a delayed output displacement.

* * * * *